United States Patent [19]

Kawaguchi et al.

[11] Patent Number: 4,983,108

[45] Date of Patent: Jan. 8, 1991

[54] LOW PRESSURE CONTAINER TYPE ROLLING PISTON COMPRESSOR WITH LUBRICATION CHANNEL IN THE END PLATE

[75] Inventors: Susumu Kawaguchi; Yoshinori Shirafuji; Hideaki Maeyama; Tatsuya Sugita; Takashi Yamamoto, all of Shizuoka, Japan

[73] Assignee: Mitsubishi Denki Kabushiki Kaisha, Tokyo, Japan

[21] Appl. No.: 412,409

[22] Filed: Sep. 26, 1989

[30] Foreign Application Priority Data

Sep. 28, 1988 [JP] Japan ..... 63-242837
Apr. 26, 1989 [JP] Japan ..... 1-106626

[51] Int. Cl.[5] ..... F04C 29/02

[52] U.S. Cl. ..... 418/63; 418/76; 418/79; 418/88; 418/91

[58] Field of Search ..... 418/76, 79, 88, 91, 418/94, 100, 63, 99

[56] References Cited

U.S. PATENT DOCUMENTS 2,883,101 4/1959 Kosfeld ..... 418/63
2,988,267 6/1961 Kosfeld ..... 418/94
2,991,931 7/1961 Galin ..... 418/91

FOREIGN PATENT DOCUMENTS 136596 8/1984 Japan ..... 418/76

*Primary Examiner*—John J. Vrablik
*Assistant Examiner*—David L. Cavanaugh
*Attorney, Agent, or Firm*—Oblon, Spivak, McClelland, Maier & Neustadt

[57] ABSTRACT

A low pressure container type rolling piston compressor which includes a compression element, a motor element, a rotary shaft with an eccentric portion driven by the motor element, a cylinder for receiving therein the eccentric portion of the rotary shaft, a rolling piston having an inner circumference to which the eccentric portion is fitted and an outer circumference which rolls along the inner wall surface of the cylinder, a vane having an end which is in contact with the outer circumference of the rolling piston to divide the inner space of the cylinder into a high pressure chamber and a low pressure chamber, a pair of bearing plates for closing both open ends of the cylinder, a sealing container housing the above-mentioned structural elements and storing at its lower part a lubricating oil wherein a pressure in the sealing container is the same as that in the low pressure chamber and wherein an oil supplying passage is formed in either one of the pair of bearing plates for closing both open ends of the cylinder so as to communicate the low pressure chamber with the inner space of the rolling piston rolling in the cylinder.

4 Claims, 4 Drawing Sheets

LOW PRESSURE CONTAINER TYPE ROLLING PISTON COMPRESSOR WITH LUBRICATION CHANNEL IN THE END PLATE

BACKGROUND OF THE INVENTION

1. Field of the Invention

The present invention relates to a rolling piston type compressor and more. More particularly, relates to a low pressure container type rolling piston compressor having an improved oil supplying means.

2. Discussion of the Background

FIG. 8 shows a conventional rolling piston type compressor disclosed in, for instance, Japanese patent application No. 161299/1988. In FIG. 8, reference numeral 1 designates a sealing container, numeral 2 designates a cylinder disposed in the sealing container 1, numeral 3 designates a rotary shaft arranged at the axial center of the cylinder 2 and having an eccentric shaft portion, numeral 4 designates a frame or a first bearing plate arranged at an end portion of the cylinder, numeral 5 designates a cylinder head or a second bearing plate arranged at the other end portion of the cylinder, numeral 6 designates a rotor, or a rolling piston revolving in the cylinder 2 in an eccentric manner, numeral 7 designates a low pressure chamber defined by the cylinder and the other elements, numeral 8 designates high pressure chamber, a numeral 9 designates a vane for dividing the inside of in the cylinder into the low pressure chamber and the high pressure chamber, numeral 10 designates a discharge muffler, numeral 11 designates a gear pump for supplying oil, numeral 12 designates a motor element, and numeral 13 designates lubricating oil.

The operation of the conventional rolling piston compressor will now be described.

When the rotary shaft 3 is driven by the motor element 12, oil is supplied from the gear pump 11 placed at an end portion of the rotary shaft 3 to the frame 4 of the rotary shaft 3, bearing portions of the cylinder head 5 and the inner circumferential portion of the rotor 6. Since the rotor 6 is rotated eccentrically in the cylinder 2 and the vane 9 is always in pressing-contact with the rotor 6, the low pressure chamber 7 and the high pressure chamber 8 are formed in the cylinder 2. Gas introduced from the intake pipe (not shown) or the sealing container 1 to the low pressure chamber 7 is compressed, and the compressed gas is discharged through the high pressure chamber 8 to be discharged through a high pressure pipe extending outside the sealing container 1 via the discharge muffler 10 and a discharge pipe (not shown).

In the conventional rolling piston compressor having the above-mentioned construction, a sufficient oil supply is obtained to the bearing portions for supporting the rotary shaft 3. In the case of a high pressure container type compressor, oil supply to the low pressure chamber 7 and the high pressure chamber 8 in the cylinder 2 is conducted by supplying oil through gaps between the structural elements and the rotor 6. However, in the low pressure container type compressor, the pressure of the inner space of the rotor 6 is always lower than that of the high pressure chamber 8 and is the substantially same as that of the low pressure chamber 7. Accordingly, oil supply through the gaps between the rotor 6 and the other structural elements can not be substantially obtained. Therefore, the sealing function in the compressor is decreased. This causes leakage of pressurized gas to increase, performance to be reduced and a use in temperature at the contacting surface between the rotor 6 and the vane 9.

SUMMARY OF THE INVENTION

It is an object of the present invention to provide a low pressure container type rolling piston compressor provided with oil supplying means capable of supplying oil to the low pressure chamber in the cylinder in a stable manner.

In accordance with the present invention, there is provided a low pressure container type rolling piston compressor comprising a compression element, a motor element, a rotary shaft with an eccentric portion driven by the motor element, a cylinder for receiving therein the eccentric portion of the rotary shaft, a rolling piston having an inner circumference to which the eccentric portion is fitted and an outer circumference which rolls along the inner wall surface of the cylinder, a vane having an end which is in contact with the outer circumference of the rolling piston to divide the inner space of the cylinder into a high pressure chamber and a low pressure chamber, a pair of bearing plates for closing both open ends of the cylinder, a sealing container housing the above-mentioned structural elements and storing at its lower part lubricating oil wherein the pressure in the sealing container is the same as that in the low pressure chamber, characterized in that an oil supplying passage is formed in either one of the pair of bearing plates for closing both open ends of the cylinder so as to communicate the low pressure chamber with the inner space of the rolling piston rolling in the cylinder.

In accordance with the present invention, there is provided a low pressure container type rolling piston compressor comprising a compression element, a motor element, a rotary shaft with an eccentric portion driven by the motor element, a cylinder for receiving therein the eccentric portion of the rotary shaft, a rolling, piston having an inner circumference to which the eccentric portion is fitted and an outer circumference which rolls along the inner wall surface of the cylinder, a vane having an end which is in contact with the outer circumference of the rolling piston to divide the inner space of the cylinder into a high pressure chamber and a low pressure chamber, a pair of bearing plates for closing both open ends of the cylinder, a sealing container housing the above-mentioned structural elements and storing at its lower part a lubricating oil wherein a pressure in the sealing container is the same as that in the low pressure chamber, characterized in that a recess for an oil sump is formed in the inner surface of at least one of the pair of bearing plates, wherein the position and the size of the recess are such that during one revolution of the rotary shaft, communication of the recess occurs with the low pressure chamber in the cylinder, closing of the recess by the end surface of the rolling piston, and communication of the recess with the inner space of the rolling piston occurs.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Several embodiments of the low pressure container type rolling piston compressor according to the present invention will now be described.

Figure 1:
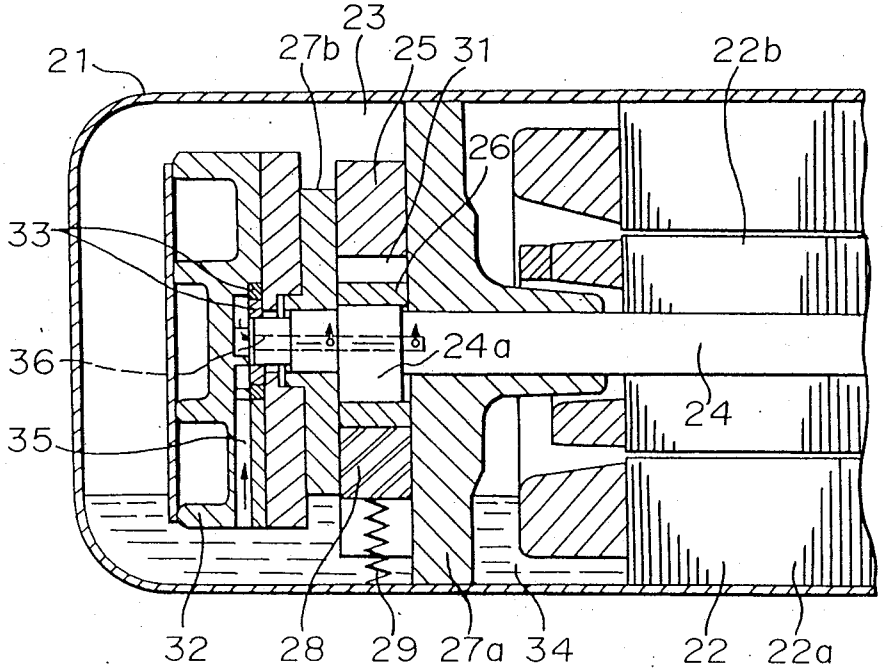
FIG. 1 is a partial longitudinal cross-sectional view of an embodiment of the low pressure container type rolling piston compressor according to the present invention.
Figure 2:
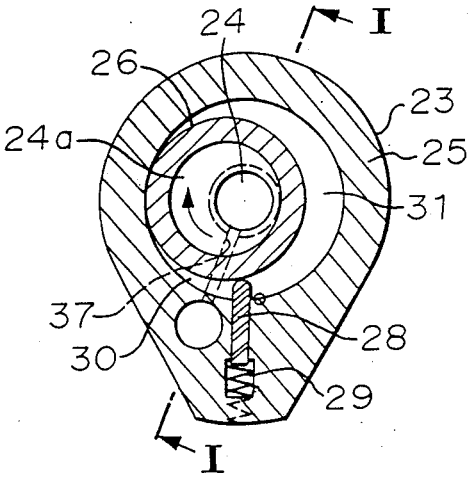
FIG. 2 is a cross-sectional view of the compressor as shown in FIG. 1.
Figure 3:
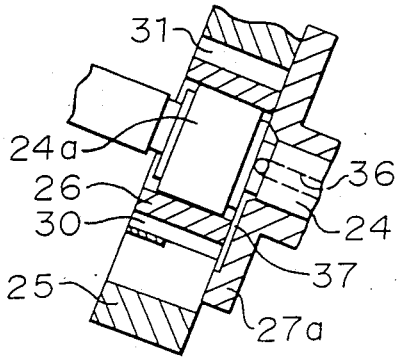
FIG. 3 is a cross-sectional view taken along a line I—I in FIG. 2.

FIGS. 1 to 3 show a first embodiment of the rolling piston compressor of the present invention. In FIGS. 1 to 3, reference numeral 21 designates a sealing container, numeral 22 designates a motor element and a numeral 23 designates a compressor element. The motor element 22 and the compressor element 23 are arranged side by side in the sealing container 21 placed with the longitudinal axial line being horizontally oriented. The motor element 22 comprises a stator 22*a* attached to the inner wall of the sealing container 21 and a rotor 21*b* rotatably fitted inside the stator 22*a*. A rotary shaft 24 is fitted to and firmly connected to the rotor 22*b*.

The compressor element 23 has a cylinder 25 in which an eccentric portion 24*a* formed in the rotary shaft 24 is inserted in the cylinder 25. A rolling piston 26 in a form of cylinder is fitted to the outer circumference of the eccentric portion 24*a* so as to effect an eccentric rotation in the cylinder 25. Both open ends of the cylinder 25 are closed by a pair of bearing plates 27*a*, 27*b* which support the rotary shaft 24 in a rotatable manner. The bearing plates 27*a*, 27*b* also support both end surfaces of the rolling piston 26. A vane 28 is held in the cylinder 25 so as to be movable in its axial direction and an end of the vane 28 is in pressing-contact with the outer circumference of the rolling piston 26 by means of a compression spring 29 so that the inner space of the cylinder 25 is divided into a low pressure chamber 30 and a high pressure chamber 31. A discharge muffler 32 is fixed to the outer end surface of the bearing plate 27*b* arranged at the opposite side of the rotary shaft 24 with respect to the motor element 22. A gear pump 3 for supplying oil by the rotary movement of the rotary shaft 24 is provided in the discharge muffler 32. Lubricating oil 34 is stored at the lower part of the sealing container 21. An oil intake pipe 35 connected to the discharge muffler 32 opens in the lubricating oil 34 and the oil intake pipe 35 is connected to the intake side of the gear pump 33. Another oil pipe 36 is connected to the discharge side of the gear pump 33. The oil pipe 36 is so constructed that it is formed in series in the discharge muffler 32, the bearing plate 27*b* and the rotary shaft 24 and it opens at the outer circumferential surface of the rotary shaft 24 so that the lubricating oil is supplied to bearing portions of the compressor element 23. Further, an oil supplying passage 37 in the form of groove is formed in the inner surface of the bearing plate 27*a* arranged at the side of motor element 22 and fixed to the sealing container 21 so as to communicate the low pressure chamber 30 with the inner space of the rolling piston 26 along the radial direction of the cylinder 25. In the above-mentioned rolling piston compressor, the pressure in the sealing container 21 is substantially the same as the pressure at the low pressure side of the compressor.

The operation of the rolling piston compressor of the above-mentioned embodiment will be described. Upon actuation of the rotary shaft 24 by the motor element 22, eccentric rotation of the rolling piston 26 is effected in the cylinder 25. Since the vane 28 is always in pressing-contact with the outer circumferential surface of the rolling piston 26, there are formed the low pressure chamber 30 and the high pressure chamber 31 in the cylinder 25. Gas introduced in the low pressure chamber 30 through the intake pipe (not shown) or the sealing container 21 is compressed and is discharged from the high pressure chamber 31 through the discharge muffler 32 to the high pressure pipe extending to the exterior of the sealing container 21 via a discharge pipe (not shown).

Actuation of the rotary shaft 24 drives the gear pump 33 attached to the end portion of the rotary shaft so that the lubricating oil 34 stored at the lower part of the sealing container 21 is sucked through the oil intake pipe 35 to be discharged through the oil pipe 36, whereby the oil is supplied to the bearing portions of the compressor element 26. In this case, although the pressure in the inner space of the rolling piston 26 is substantially the same as the pressure in the sealing container 21 and the low pressure chamber 30, there is caused a pulsation of about 0.1–0.5 kg/cm$^2$ in one revolution of the rotary shaft 24 as the volume of the low pressure chamber 30 changes. By such pulsation, the lubricating oil flows from the oil supplying passage 37 formed in the bearing plate 27*a* to the low pressure chamber 30 when the pressure in the low pressure chamber 30 is lower than that of the inner space of the rolling piston 26. The lubricating oil flowing into the low pressure chamber 30 is transferred in the same manner as the gas, and a part of the oil is discharged from the high pressure chamber 31 through the discharge muffler 32 to the high pressure pipe outside the sealing container 21 via the discharge pipe. Further, a part of the lubricating oil flowing into the low pressure chamber 30 leaks from the inside of the rolling piston 26 and the side surface of the vane 28 into the sealing container 21 other than the compressor element 23.

Leakage of the oil to the low pressure chamber 30 and the inner space of the rolling piston 26 improves the sealing properties to the gas and contributes the performance of the compressor. However, if the amount of oil discharged from the high pressure chamber 31 to the high pressure pipe (not shown) increases, the efficiency of heat exchange in a heat exchanger (not shown) decreases to thereby cause a reduction in performance. Accordingly, it is necessary to control the amount of oil escaping to the high pressure pipe to a predetermined value or lower.

In order to control the amount of oil escaping to a practically negligible range, experiments were conducted. As a result, it was found that it was necessary to determine the depth of the oil supplying passage 37 in a form of groove so as to be 0.05–0.2 mm when the width thereof is 1 mm.

Figure 4:
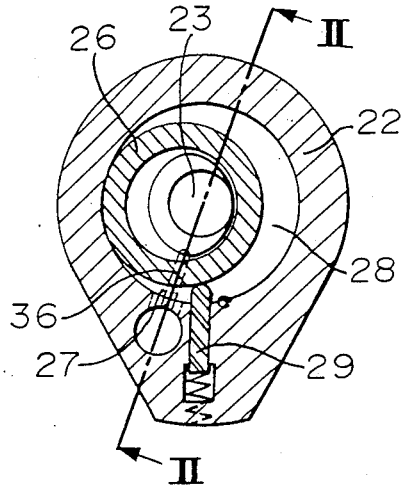
FIG. 4 is a cross-sectional view showing another embodiment of the rolling piston compressor according to the present invention.
Figure 5:
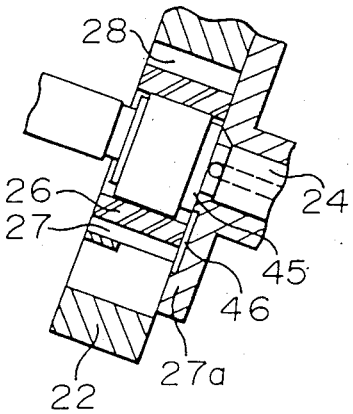
FIG. 5 is a partial cross-sectional view partly omitted taken along a line II—II in FIG. 4.

FIGS. 4 and 5 show another embodiment of the present invention. In FIGS. 4 and 5, the same reference numerals as in FIGS. 1 to 3 designate the same or corresponding parts. Numeral 45 designates a thrust bearing for supporting the rotary shaft 24, and numeral 46 designates an oil supplying passage formed in either or both of the bearing plates *27a, 27b*. However, the oil supplying passage is not communicated with the innermost portion of the thrust bearing 45. In this embodiment, it is possible to control the amount of lubricating oil escaping to the high pressure pipe so as to be a predetermined value or lower even though the depth of the groove as the oil supplying passage 46 is 0.3 mm or more where the width of the groove is 1 mm by the opening/closing operations of the thrust bearing 45 to the oil supplying passage 46. In this embodiment, it is unnecessary to determine the shape of the oil supplying passage 46 precisely.

Thus, in accordance with the above-mentioned embodiments, the lubricating oil can be supplied to the low pressure chamber and the high pressure chamber of the cylinder in a stable manner, whereby the sealing function to gas can be improved, hence the performance can be improved and an amount of wearing of the vane and the rolling piston can be reduced.

Figure 6:
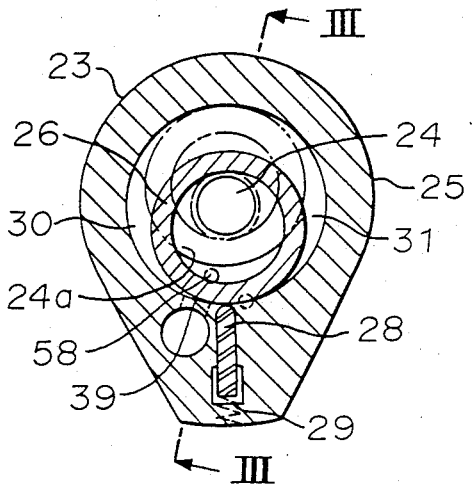
FIG. 6 is a cross-sectional view showing another embodiment of the rolling piston compressor according to the present invention.
Figure 7:
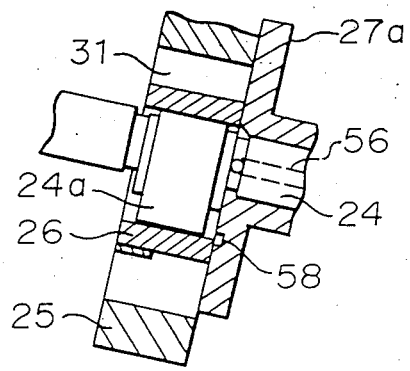
FIG. 7 is a partial cross-sectional view partly omitted taken along a line III—III in FIG. 6.
Figure 8:
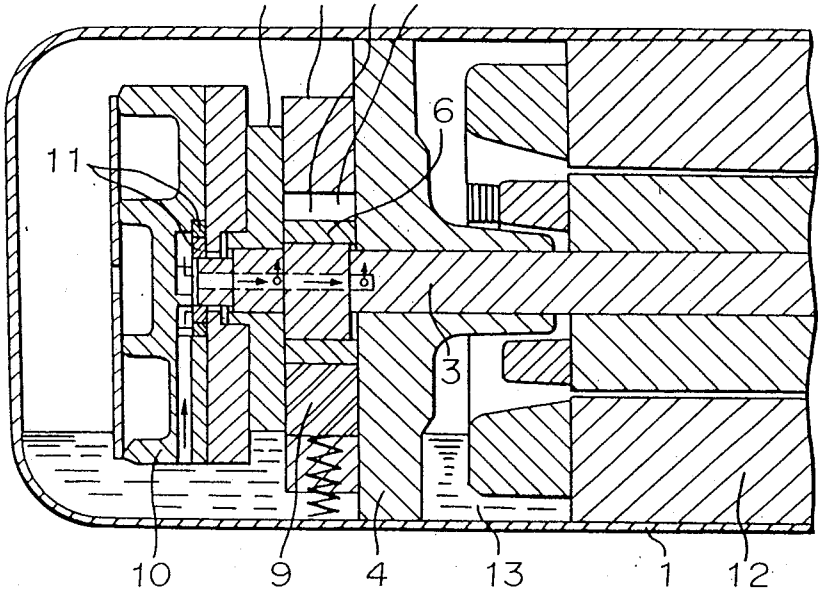
FIGURE 8 PRIOR ART
FIG. 8 is a partial longitudinal cross-sectional view of a conventional rolling piston compressor.

FIGS. 6 and 7 show another embodiment of the rolling piston compressor according to the present invention. In FIGS. 6 and 7, the same reference numerals as in FIGS. 1 to 5 designate the same or corresponding parts and therefore, description of these parts is omitted.

Numeral 58 designates a recess for an oil sump formed in the inner surface of the bearing plate *27a* instead of the oil supplying passage 36, 37. The recess for oil sump 58 is positioned and sized such that during one revolution of the rotary shaft 24, the recess 58 is communicated with the low pressure chamber 30 in the cylinder 25, that the recess 58 is closed by the end surface of the rolling piston 26, and the recess is communicated with the inner space of the rolling piston 26 occurs due to the eccentric revolution of the rolling piston. Further, recess 58 is formed in the end surface of the bearing plate *27a* facing the cylinder 25 at a position near the vane 28 with respect to an inlet 59 formed in the cylinder 25 and has a diameter smaller than the thickness in the radial direction of the rolling piston 26.

Operation of this embodiment will now be described. When the rotary shaft 24 is driven by the motor element, gas such as a refrigerant gas is introduced for compression in the low pressure chamber 30 in the cylinder 25. Operation for discharging the compressed gas to the high pressure pipe extending to outside the sealing container through the discharge pie (not shown) and operation for supplying the lubricating oil stored at the bottom of the sealing container to the bearing portions of the compressor element 23 via the oil pipe 56 (which is effected by actuating the gear pump due to the revolution of the rotary shaft 24) are the same as the above-mentioned first embodiment.

In this embodiment, the rolling piston 26 rolls along the inner circumferential wall of the cylinder 25 during revolution of the rotary shaft 24, and the lubricating oil in the inner space of the piston 26 is supplied to the recess 58 in the section where the recess 58 is exposed in the inner space of the piston 26. The lubricating oil has been introduced in the inner space of the piston 26 through the oil pipe 56.

In the section wherein the recess 58 is closed by the end surface of the rolling piston 26, the lubricating oil in the recess 58 is kept therein.

When the recess 58 is communicated with the low pressure chamber 30, the lubricating oil in the recess 58 flows into the low pressure chamber 30 by the action of a stream of intake gas, whereby the recess 58 from which the lubricating oil has been discharged is again closed by the rolling piston 26. Then, returning to the original condition, the recess 58 is communicated with the inner space of the rolling piston 26. Accordingly, the lubricating oil can be supplied to the low pressure chamber in an amount in proportion to the volume of the recess 58 regardless of conditions of pressure for each revolution of the rotary shaft 24 in the operation of the compressor, and a stable amount of oil can be supplied. In this embodiment, the recess 58 is formed at a position closer to the vane 28 with respect to the inlet 59 of the cylinder 5, and accordingly, the lubricating oil can be smoothly supplied to the vane 28, whereby the wear-resistance property of the vane 28 can be improved.

The recess 58 is formed in the bearing plate *28a* at the side of the motor element in the above-mentioned embodiment However, the recess may be formed in the bearing plate *27b*. Or it may be formed in the both bearing plates *27a, 27b*. Any type of pump may be used for the gear pump which supplies the lubricating oil. Thus, in accordance with the above-mentioned embodiment of the present invention, a constant amount of the lubricating oil can be supplied in proportion to the volume of the recess to the low pressure chamber regardless of condition of pressure, for each revolution of the rotary shaft. Accordingly, the escaping of a large amount of the lubricating oil at the time of starting can be controlled, and the lack of the lubricating oil can be eliminated. Further, when the rolling piston compressor is used for a refrigeration cycle, reduction of heat exchanging efficiency in a heat exchanger is avoidable.

I claim:

1. A low pressure container type rolling piston compressor which comprises:

a compression side, a motor side, a rotary shaft having an eccentric portion driven by said motor element, within said compression side is disposed a cylinder having opposite open ends and receiving therein said eccentric portion of the rotary shaft, and a rolling piston having an inner circumference with which said eccentric portion is fitted and an outer circumference which engages with an inner wall surface of said cylinder, a vane connected to said cylinder and having an end which is in contact with the outer circumference of said rolling piston to divide the inner space of said cylinder into a high pressure chamber and a low pressure chamber.

a pair of bearing plates for closing the opposite open ends of said cylinder, a sealing container for housing the cylinder and storing at a lower part of said sealing container a lubricating oil wherein pressure in said sealing container is substantially the same as that in said low pressure chamber, oil supplying groove means formed in an inner surface of one of said pair of bearing plates for communicating said low pressure chamber with an inner space of the rolling piston and means for supplying lubrication oil from said lubrication storage to said innerspace.

2. The low pressure container rolling piston compressor according to claim 1, wherein said oil supplying groove means is formed in an inner surface of one said bearing plates which is located at the side of the motor element so as to communicate said low pressure chamber with the inner space of said rolling piston along the radial direction of said cylinder.

3. A low pressure container type rolling piston compressor which comprises:

a compression side, a motor side, a rotary shaft having an eccentric portion driven by said motor element, within said compression side is disposed a cylinder having opposite open ends and receiving therein said eccentric portion of the rotary shaft, and a rolling piston having an inner circumference to which said eccentric portion is fitted and an outer circumference which engages with an inner wall surface of said cylinder, a vane connected to said cylinder and having an end which is in contact with the outer circumference of said rolling piston to divide an inner space portion of said cylinder into a high pressure chamber and a low pressure chamber.

a pair of bearing plates for closing both open ends of said cylinder, a sealing container for housing the cylinder and storing at a lower part of said sealing container a lubricating oil wherein pressure in said sealing container is substantially the same as that in said low pressure chamber, and means for supplying lubrication oil from said lubrication storage to said innerspaced wherein an inner surface of at least one of said pair of bearing plates has a recess for an oil sump formed therein and wherein the position and size of said recess are such that during one revolution of said rotary shaft, communication of the recess occurs with said low pressure chamber in said cylinder, closing of the recess by an end surface of said rolling piston occurs, and communication of the recess with said inner space portion of said rolling piston occurs due to the eccentric revolution of said rolling piston.

4. The low pressure container type rolling piston compressor according to claim 3, wherein said recess for the oil sump is formed in an end surface of a bearing plate facing said cylinder at a position near said vane with respect to an inlet formed in said cylinder and has a diameter smaller than a thickness dimension in the radial direction of said rolling piston.

* * * * *

US004983108B1

REEXAMINATION CERTIFICATE (1762nd)

United States Patent [19]

[11] B1 4,983,108

Kawaguchi et al.

[45] Certificate Issued Jul. 28, 1992

[54] LOW PRESSURE CONTAINER TYPE ROLLING PISTON COMPRESSOR WITH LUBRICATION CHANNEL IN THE END PLATE

[75] Inventors: Susumu Kawaguchi; Yoshinori Shirafuji; Hideaki Maeyama; Tatsuya Sugita; Takashi Yamamoto, all of Shizuoka, Japan

[73] Assignee: Mitsubishi Denki Kabushiki Kaisha, Tokyo, Japan

Reexamination Request:
No. 90/002,524, Nov. 29, 1991

Reexamination Certificate for:

| | |
|---|---|
| Patent No.: | 4,983,108 |
| Issued: | Jan. 8, 1991 |
| Appl. No.: | 412,409 |
| Filed: | Sep. 26, 1989 |

[30] Foreign Application Priority Data

| | | | |
|---|---|---|---|
| Sep. 28, 1988 | [JP] | Japan | 63-242837 |
| Apr. 26, 1989 | [JP] | Japan | 1-106626 |

[51] Int. Cl.[5] ..... F04C 29/02

[52] U.S. Cl. ..... 418/63; 418/76; 418/79; 418/88; 418/91

[56] References Cited

U.S. PATENT DOCUMENTS 4,331,002 5/1982 Ladusaw ..... 62/505

FOREIGN PATENT DOCUMENTS 0154347 9/1985 European Pat. Off. .
3135438 3/1983 Fed. Rep. of Germany .
687125 2/1953 United Kingdom .

*Primary Examiner*—John J. Vrablik

[57] ABSTRACT

A low pressure container type rolling piston compressor which includes a compression element, a motor element, a rotary shaft with an eccentric portion driven by the motor element, a cylinder for receiving therein the eccentric portion of the rotary shaft, a rolling piston having an inner circumference to which the eccentric portion is fitted and an outer circumference which rolls along the inner wall surface of the cylinder, a vane having an end which is in contact with the outer circumference of the rolling piston to divide the inner space of the cylinder into a high pressure chamber and a low pressure chamber, a pair of bearing plates for closing both open ends of the cylinder, a sealing container housing the above-mentioned structural elements and storing at its lower part a lubricating oil wherein a pressure in the sealing container is the same as that in the low pressure chamber and wherein an oil supplying passage is formed in either one of the pair of bearing plates for closing both open ends of the cylinder so as to communicate the low pressure chamber with the inner space of the rolling piston rolling in the cylinder.

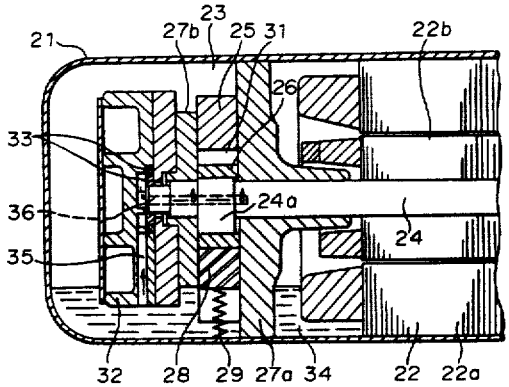

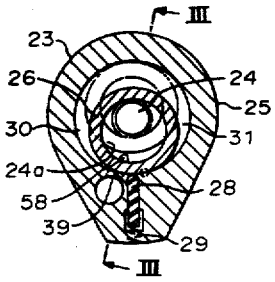

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1 and 3 are determined to be patentable as amended.

Claims 2 and 4 dependent on an amended claim, are determined to be patentable.

1. A low pressure container type rolling piston compressor which comprises:

a compression side, a motor side, a rotary shaft having an eccentric portion driven by [said] *a* motor [element],

[within said compression side is disposed] a cylinder *disposed within said compression side, said cylinder* having opposite open ends and receiving therein said eccentric portion of the rotary shaft,

[and] a rolling piston having an inner circumference with which said eccentric portion is fitted and an outer circumference which engages with an inner wall surface of said cylinder, a vane connected to said cylinder and having an end which is in contact with the outer circumference of said rolling piston to divide the inner space of said cylinder into a high pressure chamber and a low pressure chamber, a pair of bearing plates for closing the opposite open ends of said cylinder, a sealing container for housing the cylinder and storing at a lower part of said sealing container a lubricating oil wherein pressure in said sealing container is substantially the same as that in said low pressure chamber, *and* oil supplying groove means formed in an inner surface of one of said pair of bearing plates for communicating said low pressure chamber with an inner space of the rolling piston and means for supplying lubrication oil from said lubrication storage to said [innerspace] *inner space.*

3. A low pressure container type rolling piston compressor which comprises:

a compression side, a motor side, a rotary shaft having an eccentric portion driven by [said] *a* motor [element],

[within said compression side is disposed] a cylinder *disposed within said compression side, said cylinder* having opposite open ends and receiving therein said eccentric portion of the rotary shaft,

[and] a rolling piston having an inner circumference to which said eccentric portion is fitted and an outer circumference which engages with an inner wall surface of said cylinder, a vane connected to said cylinder and having an end which is in contact with the outer circumference of said rolling piston to divide an inner space portion of said cylinder into a high pressure chamber and a low pressure chamber, a pair of bearing plates for closing both open ends of said cylinder, a sealing container for housing the cylinder and storing at a lower part of said sealing container a lubricating oil wherein pressure in said sealing container is substantially the same as that in said low pressure chamber, and means for supplying lubrication oil from said lubrication storage to said [innerspaced] *inner space* wherein an inner surface of at least one of said pair of bearing plates has a recess *formed therein* for an oil sump [formed therein] and wherein the position and size of said recess are such that during one revolution of said rotary shaft, communication of the recess occurs with said low pressure chamber in said cylinder, closing of the recess by an end surface of said rolling pistoon occurs, and communication of the recess with said inner space portion of said rolling piston occurs due to the eccentric revolution of said rolling piston.

* * * * *